US006196880B1

(12) United States Patent
Goodrich et al.

(10) Patent No.: US 6,196,880 B1
(45) Date of Patent: Mar. 6, 2001

(54) COMMUNICATION CONNECTOR ASSEMBLY WITH CROSSTALK COMPENSATION

(75) Inventors: Robert Ray Goodrich, Indianapolis, IN (US); Amid Ihsan Hashim, Randolph, NJ (US)

(73) Assignee: Avaya Technology Corp., Miami Lakes, FL (US)

( * ) Notice: Subject to any disclaimer, the term of this patent is extended or adjusted under 35 U.S.C. 154(b) by 0 days.

(21) Appl. No.: 09/400,637

(22) Filed: Sep. 21, 1999

(51) Int. Cl.[7] ..... H01R 23/02
(52) U.S. Cl. ..... 439/676; 439/941
(58) Field of Search ..... 439/676, 941, 439/660, 344, 76.1, 404, 405

(56) References Cited

U.S. PATENT DOCUMENTS

| | | | | |
|---|---|---|---|---|
| 5,186,647 | | 2/1993 | Denkmann et al. | 439/395 |
| 5,299,956 | | 4/1994 | Brownell et al. | 439/638 |
| 5,580,270 | | 12/1996 | Pantland et al. | 439/395 |
| 5,941,734 | * | 8/1999 | Ikeda et al. | 439/676 |
| 5,947,772 | * | 11/1999 | Arnett et al. | 439/82 |

OTHER PUBLICATIONS

The Siemon Company, "Max" 6 Modules, On–Line Catalog (Sep. 1999).

* cited by examiner

*Primary Examiner*—Brian Sircus
*Assistant Examiner*—Son V. Nguyen
(74) *Attorney, Agent, or Firm*—Law Office of Leo Zucker

(57) ABSTRACT

A communication connector assembly including a wire board, and a number of elongated terminal contact wires extending above a top surface of the board. The contact wires have free end portions for making electrical contact with a mating connector, and base portions formed opposite the free end portions for supporting the contact wires on the board and for connecting the wires to conductors on or within the board. The base portions project normal from the top surface of the board. Pairs of the contact wires are coupled to one another along a first coupling region between their free end portions and their base portions and horizontal with respect to the top surface of the wire board, so that crosstalk introduced by the mating connector of a given polarity, is reduced over the first coupling region. The base portions are also configured to enter the wire board with a pattern defining one or more second coupling regions wherein the base portions are coupled to one another with a polarity opposite the given polarity, so that the introduced crosstalk is further reduced over the second coupling regions.

8 Claims, 7 Drawing Sheets

*FIG. 7*

TEST: NEXT
DIRECTION: FORWARD
PLUG: R25-3B

| PAIRS | DE-EMBEDDED | 50 MHz | | 100 MHz | | 200 MHz | | 250 MHz | |
|---|---|---|---|---|---|---|---|---|---|
| | PLUG VALUE | DIFF. | COM. | DIFF. | COM. | DIFF. | COM. | DIFF. | COM. |
| 1&2 | 65.00 | 77.73 | 80.78 | 70.71 | 71.91 | 66.31 | 61.70 | 65.64 | 58.56 |
| 1&3 | 37.01 | 72.04 | 72.63 | 69.95 | 66.81 | 57.94 | 61.68 | 50.52 | 53.58 |
| 1&4 | 71.12 | 69.15 | 67.86 | 62.15 | 60.96 | 53.32 | 52.81 | 50.09 | 49.94 |
| 2&3 | 48.51 | 86.37 | 79.95 | 69.83 | 73.71 | 56.54 | 61.48 | 52.06 | 56.87 |
| 2&4 | 84.27 | 85.75 | 85.71 | 80.89 | 77.51 | 70.98 | 68.18 | 66.70 | 64.52 |
| 3&4 | 47.52 | 67.84 | 66.60 | 61.53 | 59.89 | 53.82 | 51.62 | 50.77 | 48.29 |
| WP | | 67.84 | 66.60 | 61.53 | 59.89 | 53.32 | 51.62 | 50.09 | 48.29 |
| CAT 6 LIMITS | | 60.0 | 60.0 | 54.0 | 54.0 | 48.0 | 48.0 | 46.0 | 46.0 |
| WP MARGINS | | 7.83 | 6.60 | 7.53 | 5.89 | 5.32 | 3.62 | 4.09 | 2.29 |

*FIG. 8*

TEST: NEXT
DIRECTION: REVERSE
PLUG: R25-4A

| PAIRS | DE-EMBEDDED | 50 MHz | | 100 MHz | | 200 MHz | | 250 MHz | |
|---|---|---|---|---|---|---|---|---|---|
| | PLUG VALUE | DIFF. | COM. | DIFF. | COM. | DIFF. | COM. | DIFF. | COM. |
| 1&2 | 66.81 | 69.54 | 70.25 | 63.26 | 62.84 | 57.20 | 56.06 | 55.47 | 54.22 |
| 1&3 | 37.10 | 71.05 | 71.82 | 72.12 | 70.82 | 55.99 | 56.40 | 48.28 | 48.44 |
| 1&4 | 77.12 | 71.06 | 70.74 | 63.22 | 65.11 | 53.73 | 55.31 | 50.44 | 51.48 |
| 2&3 | 46.73 | 83.68 | 73.52 | 77.33 | 67.05 | 64.81 | 58.10 | 60.03 | 53.24 |
| 2&4 | 82.97 | 82.16 | 82.96 | 75.14 | 77.00 | 69.92 | 69.29 | 67.43 | 68.12 |
| 3&4 | 47.79 | 77.19 | 71.87 | 66.84 | 65.60 | 55.49 | 57.56 | 51.66 | 54.72 |
| WP | | 69.54 | 70.25 | 63.22 | 62.84 | 53.73 | 55.31 | 48.28 | 48.44 |
| CAT 6 LIMITS | | 60.0 | 60.0 | 54.0 | 54.0 | 48.0 | 48.0 | 46.0 | 46.0 |
| WP MARGINS | | 9.54 | 10.25 | 9.22 | 8.84 | 5.73 | 7.31 | 2.28 | 2.44 |

COMMUNICATION CONNECTOR ASSEMBLY WITH CROSSTALK COMPENSATION

BACKGROUND OF THE INVENTION

1. Field of the Invention

This invention relates to communication connectors that are configured to compensate for crosstalk produced between different signal paths through the connector.

2. Discussion of the Known Art

There is a need for a durable, high-frequency communication connector assembly that compensates for (i.e., cancels or reduces) crosstalk produced between different signal paths carried through the connector. As defined herein, crosstalk occurs when signals conducted over a first signal path, e.g., a pair of terminal contact wires associated with a communication connector, are partly transferred by inductive or capacitive coupling into a second signal path, e.g., another pair of terminal contact wires in the same connector. The transferred signals define "crosstalk" in the second signal path, and such crosstalk degrades any signals that are being routed over the second path.

For example, an industry type RJ-45 communication connector typically includes four pairs of terminal wires defining four different signal paths. In the conventional RJ-45 plug and jack connectors, all four pairs of terminal wires extend closely parallel to one another over the lengths of the connector bodies. Thus, signal crosstalk may be induced between and among different pairs of terminal wires, particularly in a mated RJ-45 plug and jack combination. The amplitude of the crosstalk becomes stronger as the coupled signal frequencies or data rates increase.

Applicable industry standards for rating the degree to which communication connectors exhibit crosstalk, do so in terms of near-end crosstalk or "NEXT". Moreover, NEXT ratings are typically specified for mated plug and jack combinations, wherein the input terminals of the plug connector are used as a reference plane. Communication links using unshielded twisted pairs (UTP) of copper wire are now expected to support data rates up to not only 100 MHz or industry standard "Category 5" performance, but to meet proposed "Category 6" performance levels which call for at least 46 dB crosstalk loss at 250 MHz.

U.S. Pat. No. 5,186,647 to Denkmann, et al (Feb. 16, 1993), which is assigned to the assignee of the present invention and application, discloses an electrical connector with crosstalk compensation for conducting high frequency signals. The connector has a pair of metallic lead frames mounted flush with a dielectric spring block, with connector terminals formed at opposite ends of the lead frames. The lead frames themselves include flat elongated conductors each of which includes a spring terminal contact wire at one end for contacting a corresponding terminal of a mating connector, and an insulation displacing connector (IDC) terminal at the other end for connection with an outside insulated wire lead. The lead frames are placed one over the other on the spring block, and three conductors of one lead frame have cross-over sections formed to overlap corresponding cross-over sections formed in three conductors of the other lead frame. All relevant portions of the '647 patent are incorporated by reference herein. U.S. Pat. No. 5,580,270 (Dec. 3, 1996) also discloses an electrical plug connector having crossed pairs of contact strips.

Crosstalk compensation circuitry may also be provided on or within layers of a printed wire board, to which spring terminal contact wires of a communication jack are connected within the jack housing. See U.S. patent application Ser. No. 08/923,741 filed Sep. 29, 1997, and assigned to the assignee of the present application and invention. All relevant portions of the '741 application are incorporated by reference herein. See also U.S. Pat. No. 5,299,956 (Apr. 5, 1994).

U.S. patent. application Ser. No. 09/264,506 filed Mar. 8, 1999 (now U.S. Pat. No. 6,116,964 issued Sep. 12, 2000), and assigned to the assignee of the present invention and application, discloses a communication connector assembly having generally co-planar terminal contact wires. Certain pairs of the contact wires have opposed cross-over sections near their line of contact with a mating connector, and a coupling region along the wires beyond the cross-over sections compensates for crosstalk introduced by the mating connector. All relevant portions of the '506 application are also incorporated by reference herein.

In the connector assembly of the above '506 application, the terminal contact wires have base portions that enter a wire board alternatingly along two rows which are perpendicular to the direction of the contact wires, thus defining a staggered wire board entry pattern or "footprint". Coupling of a polarity opposite to that needed for crosstalk compensation may be introduced among the base portions of the contact wires, however, and the amount of crosstalk compensation needed elsewhere (e.g., on the wire board) to achieve Category 6 performance may need to be increased as a result.

A so-called "MAX 6" modular jack outlet available from The Siemon Company has a printed wire board and four pairs of contact wires that extend generally normal to the board. No cross-over is formed in any of the wire pairs, and the contact wires enter the wire board along three rows.

A communication jack connector which, when mated with a typical RJ-45 plug, provides such crosstalk compensation that the mated connectors will meet or exceed the proposed Category 6 performance levels, is highly desirable.

SUMMARY OF THE INVENTION

According to the invention, a communication connector assembly includes a wire board, and a number of elongated terminal contact wires extending above a top surface of the board for making electrical connections with corresponding terminals of a mating connector. The contact wires have free end portions for making electrical contact with the mating connector, and base portions are formed opposite the free end portions to support the contact wires on the wire board and to connect the contact wires to conductive paths on or within the board. The base portions project in a normal direction with respect to the board.

Certain pairs of the terminal contact wires are coupled to one another along a first coupling region between their free end portions and their base portions and horizontal with respect to the top surface of the wire board, so that crosstalk introduced by the mating connector of a given polarity, is reduced over the first coupling region. Further, the base portions are configured to enter the wire board with a pattern that defines one or more second coupling regions wherein the base portions are coupled to one another with a polarity opposite the given polarity, so that the introduced crosstalk is further reduced over the second coupling regions.

For a better understanding of the invention, reference is made to the following description taken in conjunction with the accompanying drawing, and the scope of the invention will be pointed out by the appended claims.

BRIEF DESCRIPTION OF THE DRAWING

In the drawing:

FIGS. 7 and 8 are tables showing measurement results meeting Category 6 levels with the embodiment of FIGS. 1–4.

DETAILED DESCRIPTION OF THE INVENTION

Figure 1:
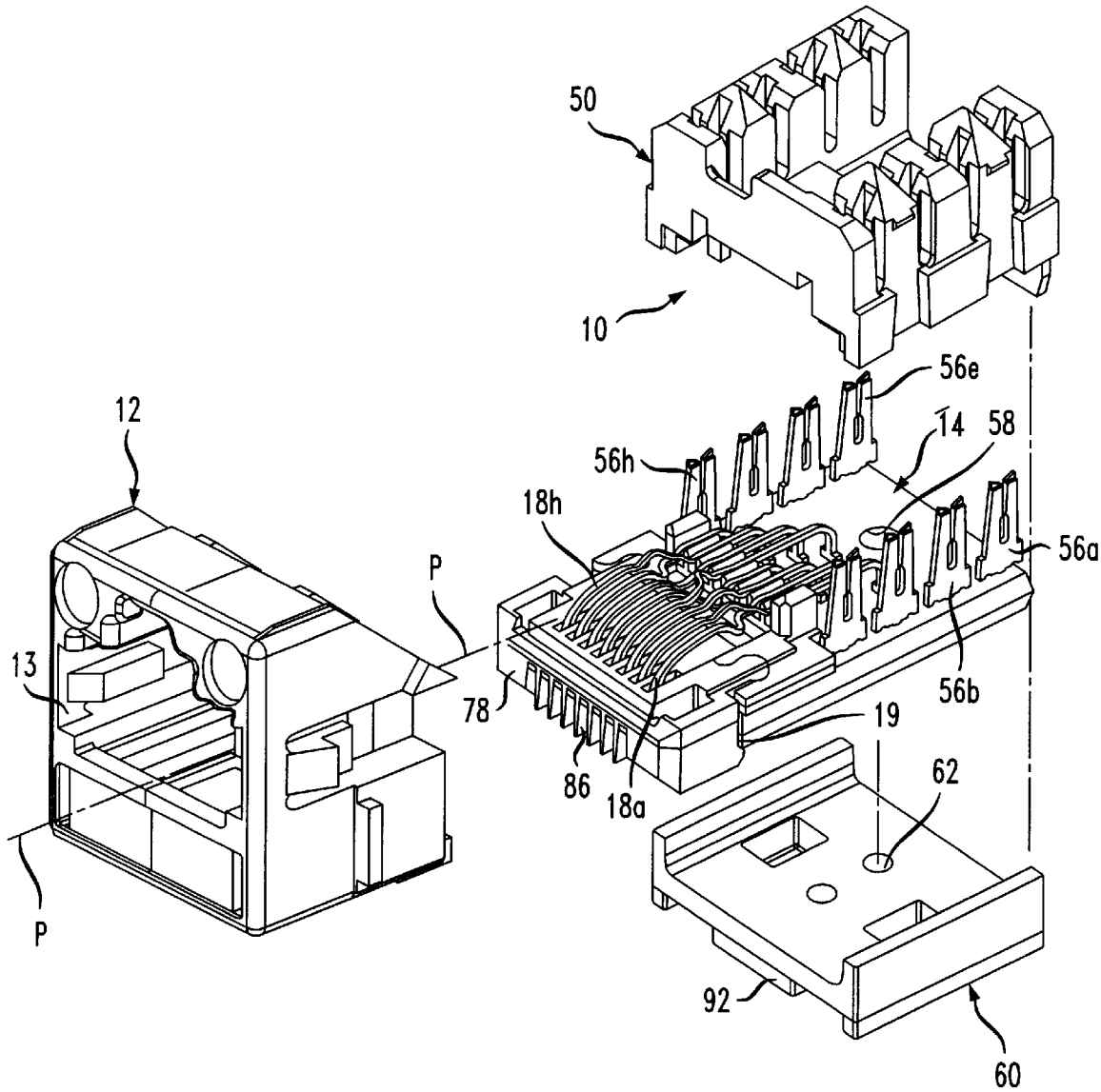
FIG. 1 is a perspective view of a first embodiment of a communication connector assembly according to the invention.
Figure 2:
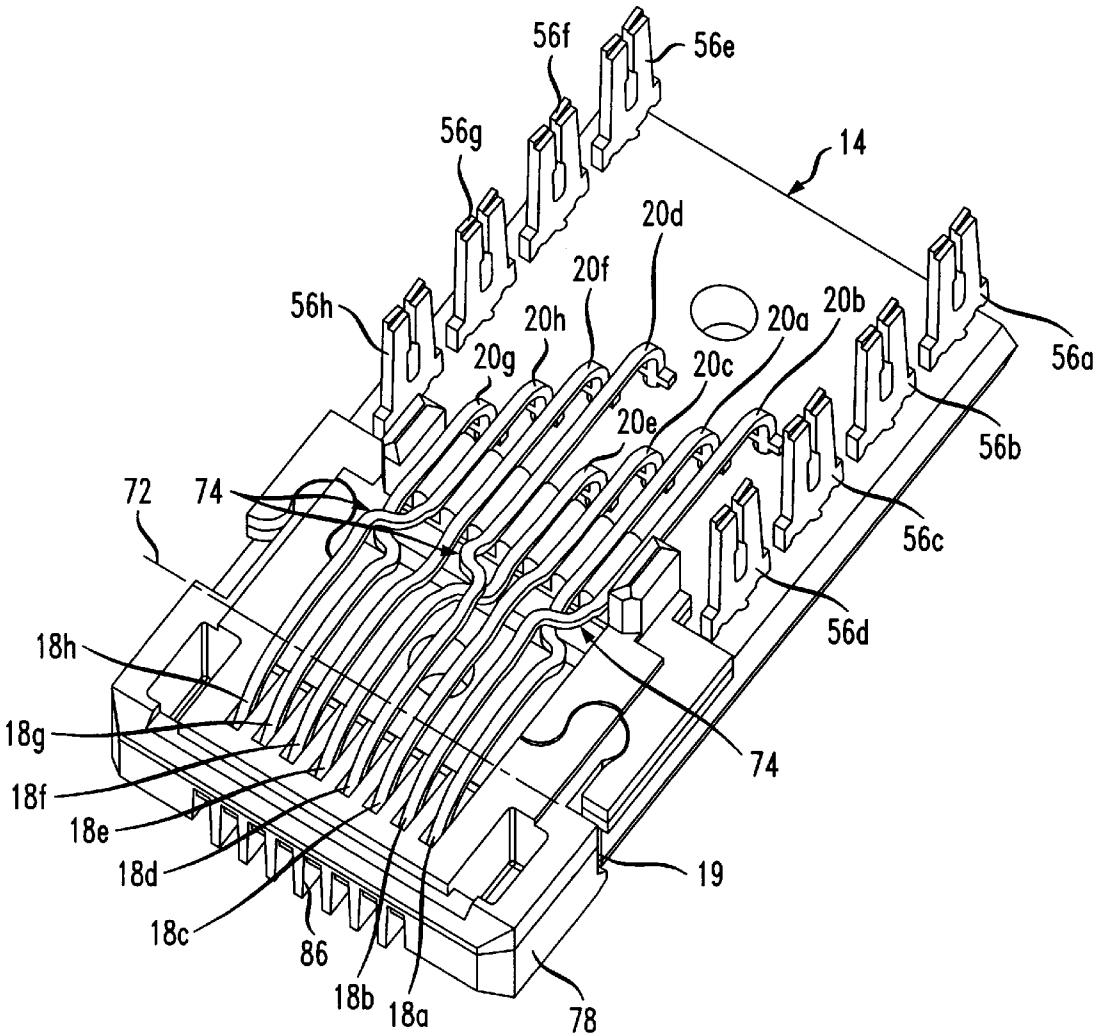
FIG. 2 is an enlarged, perspective view of a wire board portion of the connector assembly in FIG. 1.

FIG. 1 is a perspective view of a first embodiment of a communication connector assembly 10, and a communications jack frame or housing 12 with which the assembly 10 is associated. The jack housing 12 has a front face in which a plug opening 13 is formed. The plug opening 13 has an axis P along the direction of which a mating plug connector may be inserted in the jack housing 12. FIG. 2 is an enlarged, perspective view of a wire board portion of the connector assembly 10 in FIG. 1.

In the illustrated embodiment, the communication connector assembly 10 includes a generally rectangular printed wire board 14. The board 14 may be in the form of, e.g., a single or a multi-layer dielectric substrate. A number, e.g., eight elongated terminal contact wires 18*a*–18*h* extend in a generally horizontal direction with respect to a top surface of the wire board 14, substantially parallel to one another. The contact wires are generally uniformly spaced a certain distance (e.g., 0.090 inches) from the top surface of the wire board 14, and free end portions of the contact wires project beyond a front edge 19 of the board. The contact wires 18*a*–18*h* are also configured to deflect resiliently toward the board 14 when the wires are engaged by a mating connector along the direction of the plug opening axis P, i.e., in a direction parallel to the wire board 14.

The terminal contact wires 18*a*–18*h* may be formed from, e.g., a copper alloy such as spring-tempered phosphor bronze, beryllium copper, or the like. A typical cross-section for the contact wires 18*a*–18*h* is approximately 0.015 inches square.

The board 14 may incorporate electrical circuit components and devices arranged to compensate for connector-induced crosstalk. Such devices may include wire traces printed on or within layers of the board 14, as disclosed in the mentioned '741 application. Crosstalk compensation provided by the board 14 may be in addition to an initial stage of crosstalk compensation provided by the terminal contact wires 18*a*–18*h*, as explained below.

The terminal contact wires 18*a*–18*h* have associated base portions 20*a*–20*h* opposite their free end portions (see FIG. 2). Each base portion is formed to connect a contact wire to one or more conductors on or within the wire board 14. For example, the base portions 20*a*–20*h* may be soldered or press-fit in plated terminal openings formed through the board, to connect with corresponding conductive paths on or within the board. The base portions 20*a*–20*h* project in a generally normal direction with respect to the top surface of the wire board 14 (see FIG. 3).

In the embodiment of FIG. 2, the base portions 20*a*–20*h* enter the wire board 14 with a "duo diagonal" footprint, described below in connection with FIG. 4. In a second embodiment of the connector assembly 10, the base portions of the terminal contact wires enter the wire board with a "saw tooth" footprint which is also described below in connection with FIGS. 5 and 6.

An electrically insulative, dielectric terminal housing 50 (FIG. 1) covers a rear portion of the wire board 14. Outside insulated wire leads may be connected to upstanding terminals 56*a* to 56*h* on the board which terminals are only partly surrounded by housing terminal guards. The housing 50 is formed of a plastics or other insulative material that meets all applicable standards with respect to electrical insulation and flammability. Such materials include but are not limited to polycarbonate, ABS, and blends thereof. The housing 50 has, for example, at least one fastening or mounting post (not shown) that projects from a bottom surface of the housing to pass through one or more openings 58 in the board 14.

Terminals 56*a*–56*h* are mounted at opposite sides of the rear portion of the wire board 14, as seen in FIGS. 1 and 2. Each of the terminals 56*a*–56*h* has a mounting portion that is soldered or press fit in a corresponding terminal mounting hole in board 14, to connect via a conductive path (not shown) with a corresponding one of the terminal contact wires 18*a*–18*h*. When the terminal housing 50 is aligned above the IDC terminals 56*a*–56*h*, and the housing 50 is lowered to receive the IDC terminals in corresponding slots in the terminal guards, the fastening post of the housing 50 aligns with the opening 58 in the board 14, and passes through to project below the board.

A cover 60 is formed of the same or a similar material as that of the terminal housing 50. The cover 60 is arranged to protect the rear portion of the wire board from below. Cover 60 has at least one opening 62 which aligns with the tip of the fastening post of housing 50 below the wire board 14. The board 14 is thus secured between the terminal housing 50 and the cover 60, and a tip of the housing fastening post or posts is joined to the body of the cover 60. For example, a known ultrasonic welding process may be used to melt and fuse the post tip and the surrounding cover body with one another. With the wire board 14 thus captured between the terminal housing 50 and the cover 60, the rear portion of the wire board is protectively enclosed. See U.S. Pat. No. 5,924,896 issued Jul. 20, 1999, and assigned to the assignee of the present invention and application. All relevant portions of the '896 patent are incorporated by reference herein.

Figure 3:
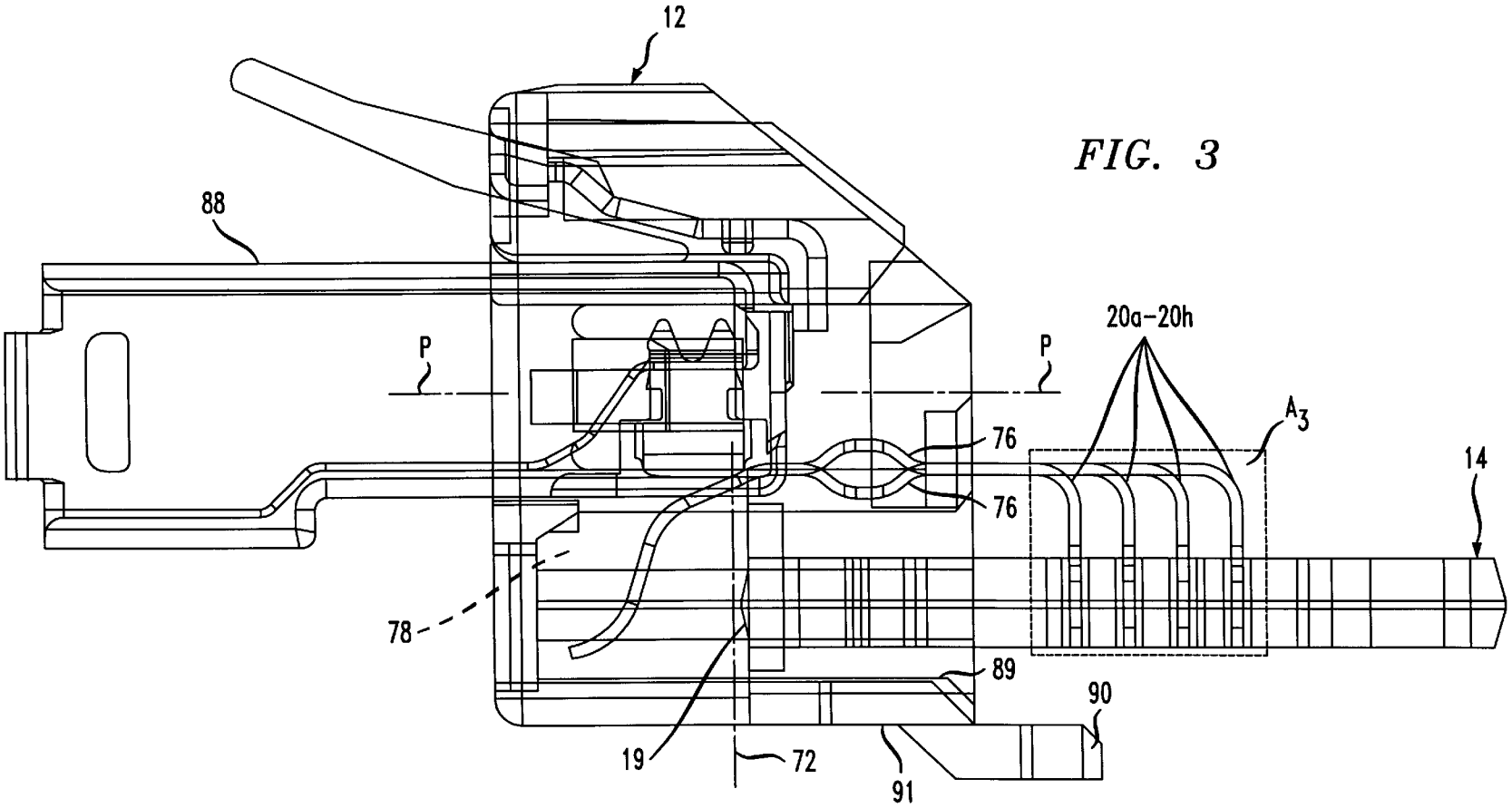
FIG. 3 is a side view of the wire board portion as seen from the right in FIG. 2, with the wire board portion inserted in a jack frame.

The free end portions of the terminal contact wires 18*a*–18*h* are formed to make electrical contact with corresponding contact wires of a mating plug connector 88 (see FIG. 3). A line of contact 72 is defined transversely of the contact wires, along which the contact wires make electrical contact with corresponding terminals of the plug connector 88. Specifically, when the contact wires 18*a*–18*h* are engaged by the mating plug connector 88 in the direction of the plug opening axis P, their free end portions deflect in unison in the direction of the board 14 as shown in FIG. 3. In the following disclosure, different pairs of the eight terminal contact wires 18*a*–18*h* are numbered and identified as follows, with reference to FIGS. 4 and 5.

| PAIR NO. | CONTACT WIRES |
|---|---|
| 1 | 18d, 18e |
| 2 | 18a, 18b |
| 3 | 18c, 18f |
| 4 | 18g, 18h |

Contact wire pair nos. 1, 2 and 4, have cross-over sections 74 at which each contact wire of a given pair is stepped toward and crosses over the other contact wire of the pair, with a generally "S"-shaped side-wise step 76. The terminal contact wires curve arcuately above and below their common plane at each cross-over section 74, as seen in FIGS. 2 and 3. Opposing faces of the step 76 in the contact wires are spaced typically by about 0.035 inches (i.e., enough to prevent shorting when the terminal wires are engaged by a mating connector).

In the illustrated embodiment, the cross-over sections 74 are formed on pairs 1, 2 and 4, i.e., contact wires 18*d*&18*e*; 18*a*&18*b*; and 18*g*&18*h*. The "pair 3" contact wires (18*c* and 18*f*) straddle either side of contact wire pair no. 1 (wires 18*d* and 18*e*), and no cross-over section is associated with the "pair 3" contact wires 18*c*, 18*f*. That is, contact wires 18*c* and 18*f* extend without a side-wise step, and pairs of contact wires that have the cross-over sections are adjacent either side of the "pair 3" contact wires 18*c*&18*f*.

The cross-over sections 74 are relatively close to the line of contact 72. Thus, crosstalk compensation by the connector assembly 10 begins to operate near the line of contact 72, beginning with the cross-over sections 74 whose centers may be located, for example, approximately 0.148 inches from the line of contact 72.

FIGS. 1–3 also show a terminal wire guide block 78 mounted over the front edge 19 of the wire board 14. The guide block 78 has equi-spaced vertical guide ways 86. The free end portions of the terminal contact wires are arranged to extend within corresponding ones of guide ways 86, and to be guided individually for vertical movement when deflected by the terminals of the mating plug connector 88 as in FIG. 3.

In FIG. 3, the wire board 14 with the terminal contact wires 18*a*–18*h* projecting from its front edge 19, is inserted in a passage 89 that opens in a rear wall of the jack housing 12. Side edges of the board 14 may be guided for entry into the housing 12 by, e.g., flanges that project inwardly from side walls of the jack housing 12. The jack housing has a slotted catch bar 90 protruding horizontally off of a bottom wall 91 of the housing. The bar 90 is arranged to receive and to hold a flange 92 (FIG. 1) that projects downward beneath the wire board cover 60, and the wire board 14 is thus fixed securely in an operative position inside the jack housing. With the entire connector assembly 10 joined to the jack housing 12, the surface of the wire board 14 is parallel to the plug opening axis P, along the direction of which the plug connector 88 engages and disengages the free end portions of the contact wires 18*a*–18*h*.

As disclosed herein, the connector assembly 10 produces predominantly inductive crosstalk compensation coupling among co-planar portions of the terminal contact wires 18*a*–18*h*, beyond the cross-over sections 74 and between the free end portions and the base portions of the wires, in such a manner as to create an initial stage of crosstalk compensation. This initial stage opposes or compensates for crosstalk introduced when the free end portions of the contact wires operatively engage the terminals of the plug connector 88.

Duo-Diagonal Footprint

Figure 4:
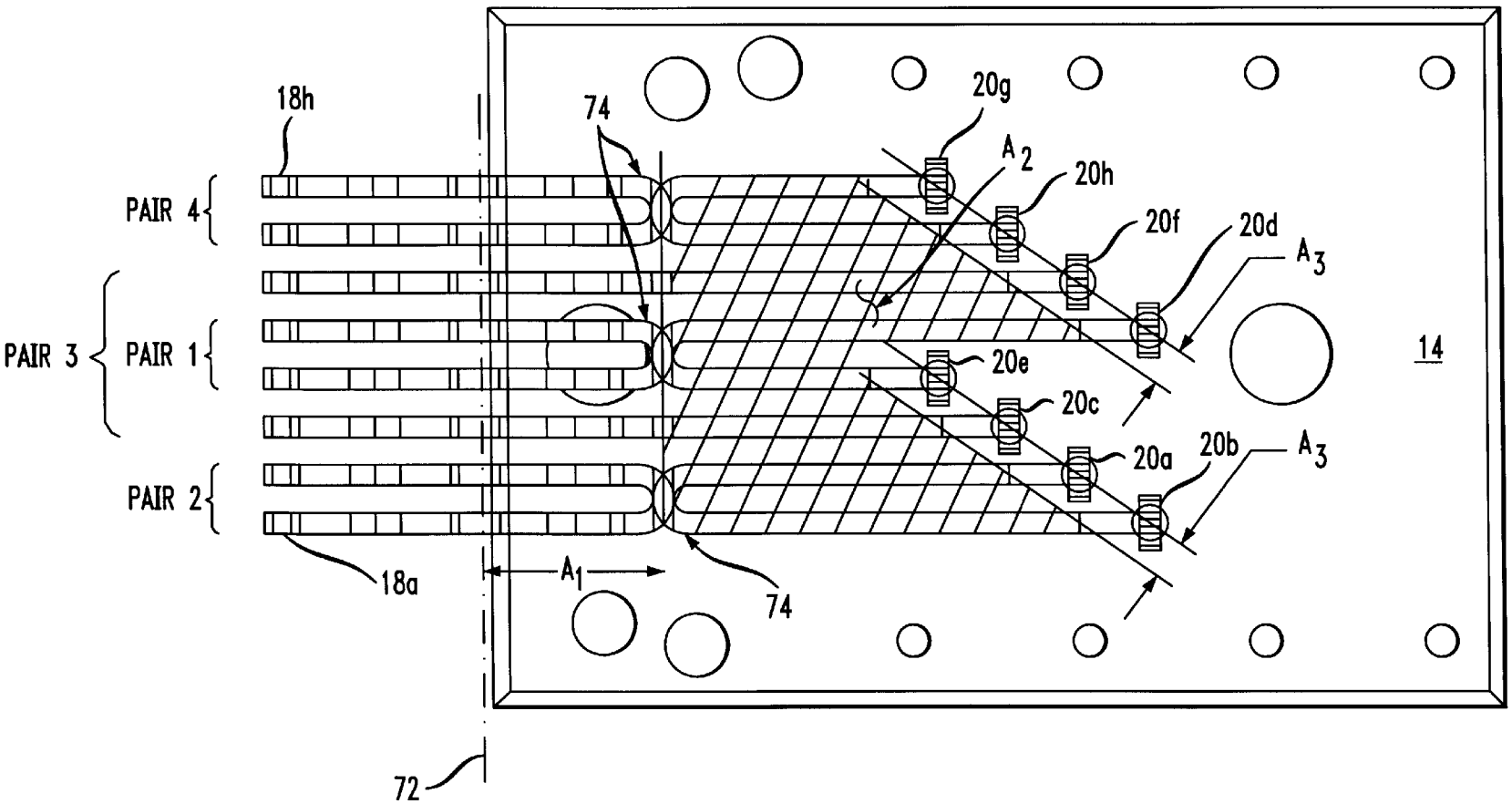
FIG. 4 is a plan view of the wire board portion in FIG. 2.

FIG. 4 is a plan view of the connector assembly 10, wherein the base portions 20*a*–20*h* enter the wire board 14 with a duo-diagonal footprint pattern. Measurements shown on the drawing are typical dimensions in inches, and are not intended to limit the invention with respect to any particular dimension or sets of dimensions. The points of entry of the base portions define four rows on the wire board 14, which rows are substantially perpendicular to the long direction of the terminal contact wires 18*a*–18*h*. The points of entry also define two successive diagonal lines through the rows.

Region $A_1$ corresponds to a zone in which offending crosstalk is introduced by a mating connector. Since region A, begins with the line of contact 72, and ends at the center of the cross-over sections 74, the horizontal distance of region $A_1$ is kept as short as possible, e.g., about 0.148 inches in FIG. 4. Here, a short distance minimizes transmission delay and reduces the overall amount of inductive and capacitive compensation required of the connector assembly 10 to counter the effects of the offending crosstalk.

Region $A_2$ defines a zone in which portions of the contact wires 18*a*–18*h* are horizontal and co-planar with one another between the cross-over sections 74 and the base portions 20*a*–20*h*, with a substantially uniform spacing (e.g., about 0.090 inches) above the board surface. See FIG. 3. Sides of adjacent contact terminal wires are spaced apart typically by about 0.025 inches in region $A_2$, and inductive and capacitive compensation coupling is very effective among the contact wires.

Regions $A_3$ in FIG. 3 represent a zone where the contact wires bend and the base portions 20*a*–20*h* extend generally normally of the wire board 14 to enter terminal openings in the board. In the regions $A_3$, centers of adjacent base portions are spaced typically by about 0.060 inches in the long direction of the contact wires, i.e., by a spacing greater than the typical 0.040 inch center-to-center spacing of the contact wires at their line of contact 72 with a mating connector.

As seen in FIGS. 3 and 4, each region $A_3$ includes adjacent base portions which are substantially parallel and co-planar with one another in a direction normal to the wire board 14. Inductive as well as capacitive crosstalk compensation coupling will therefore be produced among the base portions in each region $A_3$, when the adjacent base portions are ordered as shown in FIG. 4 and described below.

Saw Tooth Footprint

Figure 5:
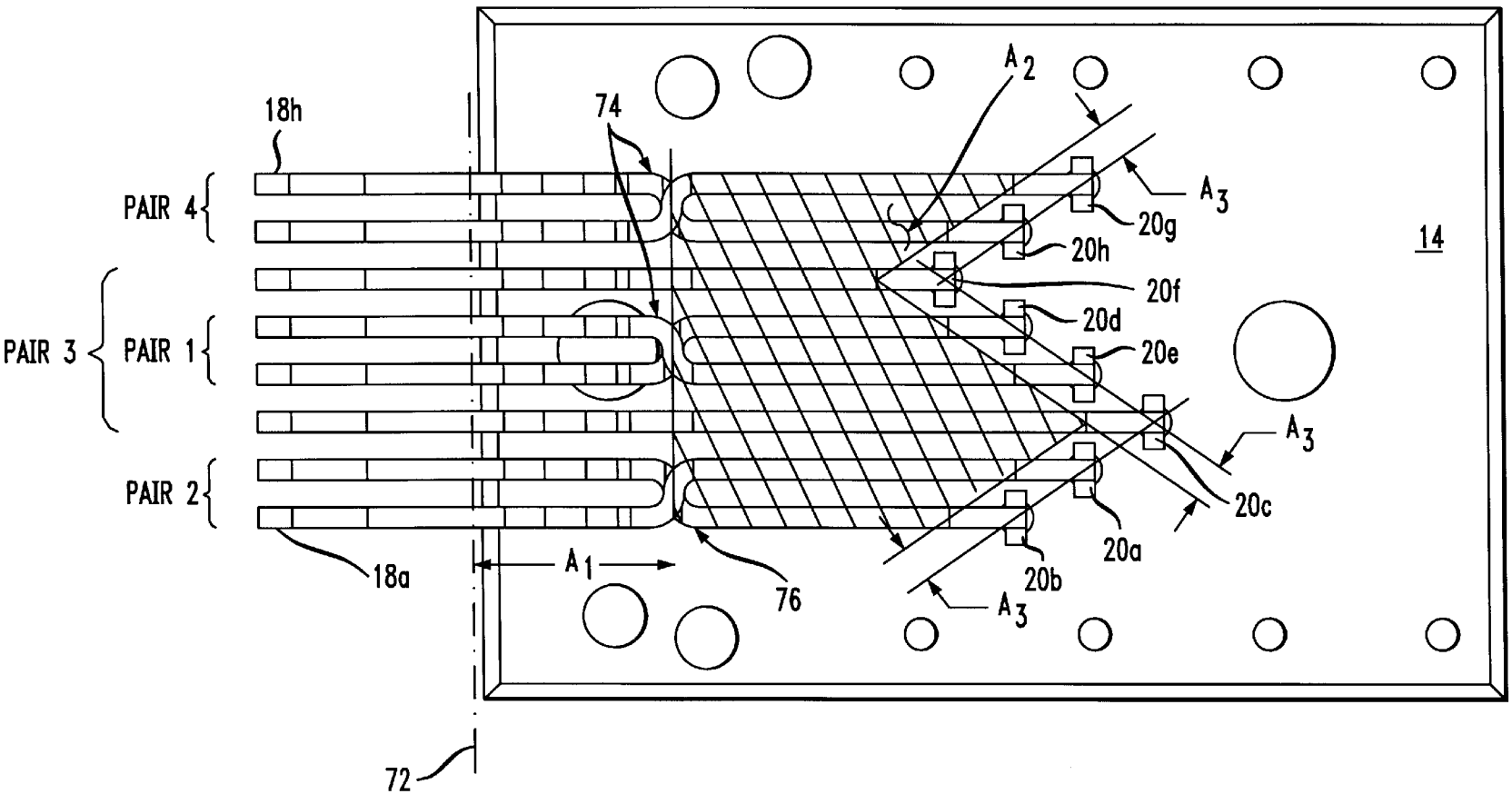
FIG. 5 is a plan view of a second embodiment of the wire board portion of the connector assembly in FIG. 1.
Figure 6:
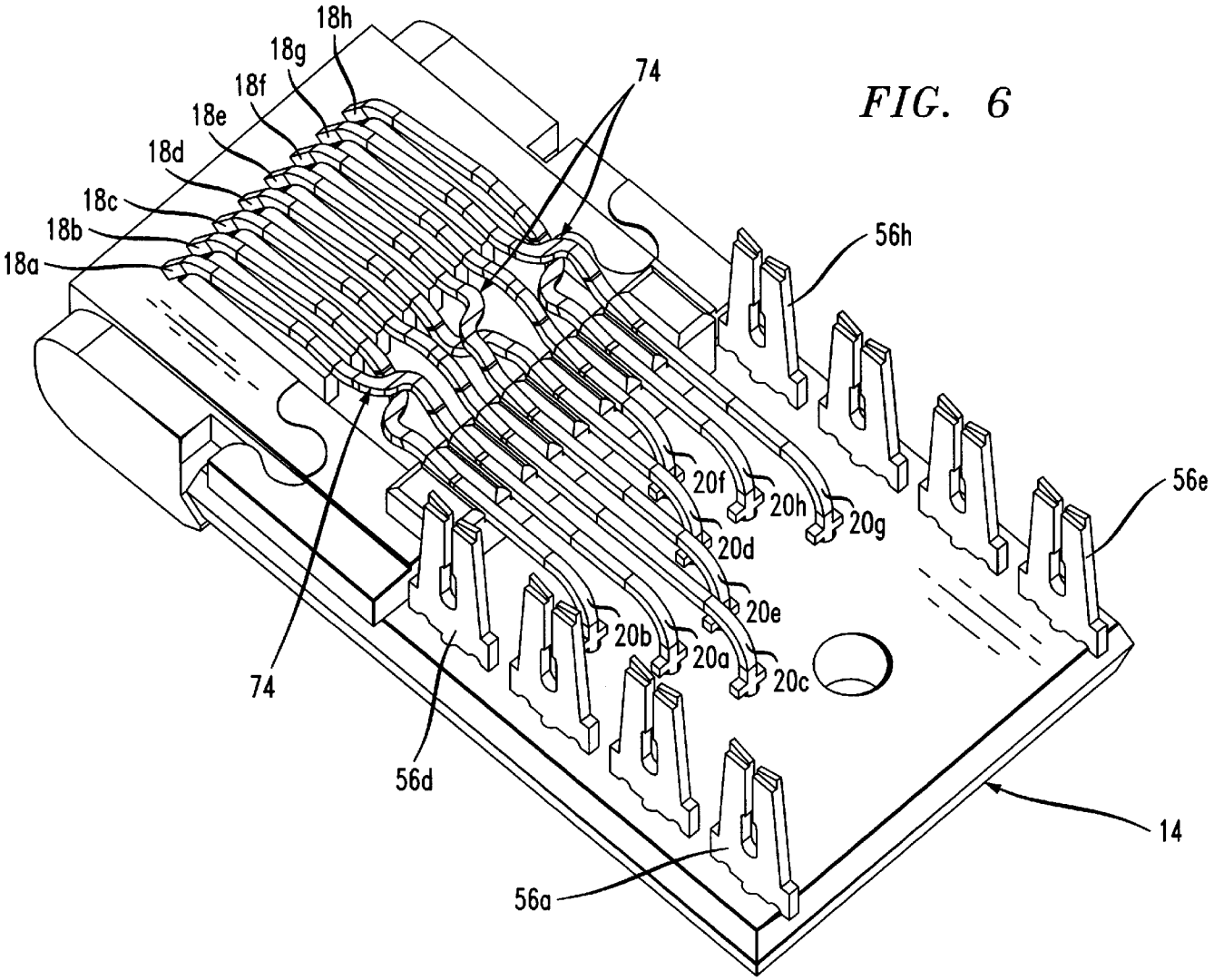
FIG. 6 is a perspective view of the wire board portion in FIG. 5.

FIG. 5 is a plan view of the connector assembly 10, wherein the base portions 20*a*–20*h* of the terminal contact wires enter the wire board 14 with a foot print pattern resembling a coarse saw tooth. FIG. 6 is a perspective view of the wire board 14 in FIG. 5. The points of entry of the base portions define four rows on the wire board 14, which rows are sustantially perpendicular to the long direction of the contact wires. The entry pattern also forms a saw tooth running through the rows.

A region $A_1$ in FIG. 5, between the line of contact 72 and a center line through the cross-over sections 74 of the contact wires, defines a zone where offending crosstalk may be introduced by a mating connector. As mentioned, the length of region $A_1$ in the direction of the contact wires is kept relatively short (e.g., about 0.148 inches) to minimize transmission delay and to reduce the amount of inductive and capacitive compensation needed to counter the offending crosstalk.

Region $A_2$ in FIG. 5 depicts an effective inductive and capacitive coupling zone among horizontal portions of the terminal contact wires 18*a*–18*h*. In region $A_2$, the contact wires lie in substantially the same plane and are horizontal with respect to the surface of the wire board 14, with a substantially uniform spacing (e.g., 0.090 inches) above the surface of the board 14. Assuming a typical center-to-center spacing of 0.040 inches for the contact wires at the line of contact 72, and 0.015 inch square cross sections for the contact wires, sides of adjacent wires in region $A_2$ are spaced typically about 0.025 inches apart.

Regions $A_3$ in FIG. 5 represent zones where the contact wires bend and the base portions 20*a*–20*h* extend generally normal to the wire board 14, to enter terminal openings in the board. Adjacent base portions in each region $A_3$ are spaced apart typically by about 0.060 inches in the long direction of the contact wires, i.e., by a spacing greater than the typical 0.040 inch spacing between centers of the contact wires at their line of contact 72 with a mating connector.

As seen in FIGS. 3 and 5, each region $A_3$ comprises adjacent base portions which are substantially parallel and co-planar with one another in a direction normal to the wire board 14. Inductive and capacitive crosstalk compensation coupling is produced among the base portions in each region $A_3$, when the adjacent base portions are ordered as shown in FIG. 5 and described below.

Pairs 1 and 3

At the line of contact 72, it is seen in FIGS. 4 and 5 that contact wire 18*d* of pair 1 is adjacent to contact wire 18*c* of pair 3. At the wire board entry regions $A_3$, a relation that contributes effectively to crosstalk compensation is one that positions base portion 20*e* of pair 1 closer to base portion 20*c* of pair 3, and base portion 20*d* of pair 1 further from base portion 20*c* of pair 3. Likewise, base portion 20*d* of pair 1 is positioned closer to base portion 20*f* of pair 3, while base portion 20*e* of pair 1 is placed further from base portion 20*f* of pair 3. The configurations in either of FIGS. 4 or 5 satisfy such relationships.

Pairs 2 and 3

At the line of contact 72, terminal contact wire 18c of pair 3 is adjacent to wire 18*b* of pair 2. At the wire board entry region $A_3$, a relation that contributes effectively to crosstalk compensation is one that brings base portion 20*c* of pair 3 closer to base portion 20*a* of pair 2, and base portion 20*c* of pair 3 further from base portion 20*b* of pair 2. As seen in FIGS. 4 and 5, base portion 20*c* is adjacent to base portion 20*a* in the region $A_3$, while base portion 20*b* is separated from base portion 20*c* by the base portion 20*a* in region $A_3$.

Pairs 3 and 4

With respect to base portions 20*c*, 20*f*; and 20g, 20*h* for wire pairs 3 and 4, the relation in their wire board entry pattern corresponds to that for the base portions of wire pairs 2 and 3.

Pairs 1 and 2 he entry patterns for base portions 20*d*, 20*e* of pair 1, and 20*a*, 20*b* of pair 2 in FIGS. 4 and 5, are such that the sum of (a) the distance between base portions 20*a* and 20*d*, and (b) the distance between base portions 20*b* and 20*e*; minus the sum of (c) the distance between base portions 20*a* and 20*e*, and (d) the distance between base portions 20*b* and 20*d*, is minimized. Such a relation tends to minimize the amount of any offending crosstalk introduced by the base portions.

Pairs 1 and 4

For base portions 20*d* and 20*e* of pair 1, and base portions 20*g* and 20*h* of pair 4, the relationship in their wire board entry pattern corresponds to that described for pairs 1 and 2 above.

With the cross-over sections 74 formed in wire pairs 1, 2 and 4, either of the "duo-diagonal" or the "saw tooth" entry patterns of FIGS. 4 and 5 produces crosstalk compensation coupling among the base portions 20*a*–20*h* of the terminal contact wires, which coupling is of a polarity opposite to that of any offending crosstalk introduced into region $A_1$ of the contact wires by a mating connector. As mentioned earlier, existing connector assemblies may have such wire board entry patterns that coupling of the same polarity as that of offending crosstalk, is produced at base portions of some of the assembly contact wires. Thus, any beneficial compensation coupling produced in other sections of the contact wires may be negated by the wire board entry pattern in the connector assembly. The overall configurations of FIGS. 4 and 5 therefore give rise to the following important benefits:

1. The amount of additional compensation stages required on or within the wire board 14 is minimized;
2. Proposed Category 6 requirements can be met with better margins; and
3. A better return loss can be realized.

FIGS. 7 and 8 are tables showing NEXT measurement results when using the duo-diagonal entry pattern of the contact wire base portions 20*a*–20*h*, as in FIGS. 1–4, and with additional compensation within the wire board 14. Category 6 performance was obtained in both forward (FIG. 7) and reverse (FIG. 8) crosstalk measurements.

While the foregoing description represents preferred embodiments of the invention, it will be obvious to those skilled in the art that various changes and modifications may be made, without departing from the spirit and scope of the invention pointed out by the following claims.

We claim:

1. A communication connector assembly, comprising:

a wire board;

a number of elongated terminal contact wires extending above a top surface of the wire board for making electrical connections with corresponding terminals of a mating connector, wherein the contact wires include:

free end portions for making electrical contact with the mating connector;

base portions opposite the free end portions, wherein the base portions are formed to support the contact wires on the wire board and to connect the contact wires to conductive paths on or within the board, and the base portions project in a normal direction with respect to the top surface of the board;

certain pairs of the terminal contact wires are coupled to one another along a first coupling region between the free end portions and the base portions of said wires and horizontal with respect to the top surface of the wire board, wherein crosstalk of a certain polarity introduced by the mating connector is reduced over the first coupling region; and the base portions of the terminal contact wires are configured to enter the wire board with an entry pattern that defines one or more second coupling regions wherein the base portions are coupled to one another with a polarity opposite said certain polarity so that said crosstalk is further reduced over the second coupling regions.

2. A connector assembly according to claim 1, wherein the base portions of the terminal contact wires enter the wire board at positions along four parallel rows that are perpendicular to the direction of the contact wires above the top surface of the wire board.

3. A connector assembly according to claim 2, wherein the number of said terminal contact wires is eight, and the base portions of the contact wires enter the wire board at said positions defining two parallel lines drawn diagonally through said four parallel rows.

4. A connector assembly according to claim 2, wherein the number of said terminal contact wires is eight, and the base portions of the contact wires enter the wire board at said positions defining three connected lines drawn diagonally through said four parallel rows.

5. A communication jack connector, comprising:

a jack housing having a plug opening, the plug opening having an axis and the housing being constructed and arranged for receiving a mating plug connector in the plug opening along the direction of the plug axis; and a communication connector assembly for electrically contacting said mating plug connector when the plug connector is received in the jack housing, said connector assembly comprising:

a wire board having a front portion which is supported in the jack housing;

a number of elongated terminal contact wires extending above a top surface of the wire board for making electrical connections with corresponding terminals of a mating connector, wherein the contact wires include:

free end portions for making electrical contact with the plug connector inside the jack housing;

base portions opposite the free end portions, wherein the base portions are formed to support the contact wires on the wire board and to connect the contact wires to conductive paths on or within the board, and the base portions project in a normal direction with respect to the top surface of the board;

certain pairs of the terminal contact wires are coupled to one another along a first coupling region between the free end portions and the base portions of said wires and horizontal with respect to the top surface of the wire board, wherein crosstalk of a certain polarity introduced by the plug connector is reduced over the first coupling region; and the base portions of the terminal contact wires are configured to enter the wire board with an entry pattern that defines one or more second coupling regions wherein the base portions are coupled to one another with a polarity opposite said certain polarity so that said crosstalk is further reduced over the second regions.

6. A jack connector according to claim 5, wherein the base portions of the terminal contact wires enter the wire board at positions along four parallel rows that are perpendicular to the direction of the contact wires above the top surface of the wire board.

7. A jack connector according to claim 6, wherein the number of said terminal contact wires is eight, and the base portions of the contact wires enter the wire board at said positions defining two parallel lines drawn diagonally through said four parallel rows.

8. A jack connector according to claim 6, wherein the number of said terminal contact wires is eight, and the base portions of the contact wires enter the wire board at said positions defining three connected lines drawn diagonally through said four parallel rows.

* * * * *